US009878354B1

(12) United States Patent
McFarlane

(10) Patent No.: US 9,878,354 B1
(45) Date of Patent: Jan. 30, 2018

(54) VALVE GUIDE REAMER FOR ENGINES METHOD AND DEVICE

(71) Applicant: HORIZON, LLC, Baldwin, KS (US)

(72) Inventor: David A. McFarlane, Baldwin City, KS (US)

(73) Assignee: Horizon, LLC, Baldwin, KS (US)

( * ) Notice: Subject to any disclaimer, the term of this patent is extended or adjusted under 35 U.S.C. 154(b) by 42 days.

(21) Appl. No.: 15/192,465

(22) Filed: Jun. 24, 2016

(51) Int. Cl.
*B08B 9/027* (2006.01)
*B08B 9/043* (2006.01)
*B08B 9/045* (2006.01)

(52) U.S. Cl.
CPC ..... *B08B 9/0436* (2013.01); *B08B 9/045* (2013.01); *Y10T 137/0435* (2015.04); *Y10T 137/4273* (2015.04)

(58) Field of Classification Search
CPC . B08B 9/0436; B08B 9/045; Y10T 137/4273; Y10T 137/4336
See application file for complete search history.

(56) References Cited

U.S. PATENT DOCUMENTS 4,231,693 A * 11/1980 Kammeraad ..... B23D 77/00 29/401.1
5,775,853 A * 7/1998 Keefer et al. ..... B23B 31/261 408/1 R
5,921,728 A * 7/1999 Kammeraad et al. . B23D 77/00 408/227
7,207,752 B2 * 4/2007 Schulte ..... B23D 77/00 408/1 R
8,025,075 B2 * 9/2011 Zuck ..... F16K 24/04 137/244
8,097,090 B2 * 1/2012 Freel et al. ..... B08B 9/00 110/344

OTHER PUBLICATIONS

Textron Lycoming Service Table of Limits and Torque Value Recommendations, SSP1776, dated Apr. 30, 1979, 174 pages.
Textron Lycoming Service Instruction, Service Instruction No. 1425A, dated Jan. 19, 1988, 4 pages.
Textron Lycoming Service Bulletin, Service Bulletin No. 388C, dated Nov. 22, 2004, 13 pages.

* cited by examiner

*Primary Examiner* — Kevin Lee
(74) *Attorney, Agent, or Firm* — Lathrop Gage L.L.P.

(57) ABSTRACT

Cleaning reamer devices and methods for cleaning the interior of a valve guide are described. One cleaning reamer includes a straight shank, a body, and a piloted portion. The piloted portion is dimensionally sized and shaped to be substantially equivalent to the valve stem that is positioned within the valve guide to be cleared of deposits. The body of the cleaning reamer is fluted or straight.

13 Claims, 3 Drawing Sheets

VALVE GUIDE REAMER FOR ENGINES METHOD AND DEVICE

BACKGROUND OF THE INVENTION

The present invention relates, in general, to valve guides, valve guide reamers, and, more particularly, maintenance and cleaning thereof. Generally, a variety of valves exist in an engine, such as camshaft cylinder, solenoid transmission, etc., for many different uses, such as automobiles, boats, aircraft, etc.

A common problem among engine valves, in particular in oil or gas infused valves is sticking, where there is buildup of deposits. Sources of the deposits are varied, including combustion by-products and oil contaminates. The lead salts that accumulate in the lubricating oil from the use of leaded fuels contribute to the deposit build up in the valve guides. They are mostly eliminated each time the oil and filter are changed. Depending on the amount of deposits, sticking between the valve stem and guide can restrict the valve movement and cause the valve to malfunction. This condition, where a valve is stuck or sticking occurs when contaminants in the engine lubrication oil or exhaust by products become deposited on the valve stems and guides, restricting the valve movement, and resulting in intermittent engine hesitation or miss. Factors exist that contribute to the rate of deposit accumulation, such as high ambient temperatures, reduced cool off time, and high lead content of fuel. If the valve is sticking or stuck, then cleaning is recommended. Similarly, many engine manufactures recommend cleaning as a routine preventative measure.

The exact clearance between a valve stem and the inner diameter of a valve guide is critical to proper operation. Because of this, valve guides are typically manufactured undersized to allow the inner diameter to be perfected after installation. The manufacturers of such valve guides typically make special reamers for initially perfecting this diameter after installation. These reamers are usually fluted and typically have a pilot portion near one end that has a diameter significantly less than the diameter of the finished valve guide. The pilot portion of these reamers is sized to fit the initial undersized inner diameter of the valve guide and thus ensure proper alignment before the larger diameter main portion of the reamer begins cutting the valve guide to its final perfected diameter. Cleaning is traditionally done with one of these reamers sized for use after initial installation of the valve guide, or put another way, with a reamer with a pilot section sized to fit the original undersized valve guide inner diameter. Although appropriate for initial installation, the significantly undersized pilot minor diameter is inappropriate for cleaning operations and causes the reamer to wander and misalign while it is being started and turned in the valve guide hole. This results in excess material removal and causes the valve guide hole to be deformed with a larger diameter than optimal at the end the reamer is started.

The purpose of cleaning a valve guide is to ream the inner diameter of the valve guide back to its initial conditions by removing deposited contaminants from the valve guide inner diameter. However, none of the reamers traditionally used for this operation have an appropriately sized pilot section to ensure proper reamer alignment so that only the deposits are removed without removing base metal material and distorting the valve guide hole.

BRIEF SUMMARY OF THE INVENTION

The following presents a simplified summary of the invention in order to provide a basic understanding of some aspects of the invention. This summary is not an extensive overview of the invention. It is not intended to identify critical elements of the invention or to delineate the scope of the invention. Its sole purpose is to present some concepts of the invention in a simplified form as a prelude to the more detailed description that is presented elsewhere.

The inventive device includes a cleaning reamer providing a reamer having a straight shank and a body with a pilot section. The body may have a first diameter between 0.404 inches and 0.5005 inches, and the pilot section may have a second diameter being substantially equivalent to a valve stem diameter between 0.4012 inches and 0.4965 inches. In one embodiment of the invention, the pilot section second diameter is between 0.4012 and 0.402 inches. In another embodiment of the invention, the pilot section second diameter is between 0.432 and 0.433 inches. In another embodiment of the invention, the pilot section second diameter is between 0.4935 and 0.4945 inches. In another embodiment of the invention, the pilot section second diameter is between 0.4957 and 0.4965 inches.

One method for cleaning a valve guide includes the steps of providing a valve assembly including a valve housing with at least one valve guide bore having an inner diameter between 0.404 inches and 0.5005 inches, wherein the at least one valve guide bore holds within it a corresponding valve, the valve having a valve stem and a valve head, the valve stem having a stem diameter between 0.4012 inches and 0.4965 inches, and removing the valve from the at least one valve guide bore; providing a reamer having a straight shank and a body with a pilot section, the body having a first diameter between 0.404 inches and 0.5005 inches and the pilot section having a second diameter being substantially equivalent to the stem diameter; inserting and rotating the reamer within the valve bore to clean the bore. The cleaning reamer may further include an attachment portion to be secured to a tool.

Another method of the invention for cleaning a valve guide includes the steps of: providing a valve assembly including a valve housing; providing a first reamer having an outer diameter between 0.404 inches and 0.5005 inches; reaming a valve bore within the valve housing, the valve bore being sized and shaped to support within it a corresponding valve, the valve having a valve stem and a valve head, the valve stem having a stem diameter between 0.4012 inches and 0.4965 inches; removing the valve from the valve bore; providing a second reamer having a straight shank and a body with a pilot section, the body having a first diameter equivalent to the outer diameter of the first reamer and the pilot section having a second diameter being substantially equivalent to the stem diameter; and inserting and rotating the second reamer within the valve bore to clean the bore.

Yet another method of the invention for cleaning a valve guide of an aircraft includes the steps of: removing a valve from within a valve guide; providing a cleaning reamer with a piloted section equal to the size of a valve stem utilized within the valve guide; inserting and rotating the cleaning reamer within the valve guide to clean the valve guide; and removing the cleaning reamer by pulling out the cleaning reamer from the valve guide.

BRIEF DESCRIPTION OF THE DRAWINGS

The drawings constitute a part of this specification and include exemplary embodiments of the present invention and illustrate various objects and features thereof.

A further understanding of the invention may be had by reference to the accompanying drawing in which.

DETAILED DESCRIPTION OF THE INVENTION

As required, detailed embodiments of the present invention are disclosed herein; however, it is to be understood that the disclosed embodiments are merely exemplary of the invention, which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure. It is also noted that any reference to the words top, bottom, up and down, and the like, in this application refers to the alignment shown in the various drawings, as well as the normal connotations applied to such devices, and is not intended to restrict positioning of the connecting member assemblies of the application and cooperating bone anchors in actual use.

Figure 1:
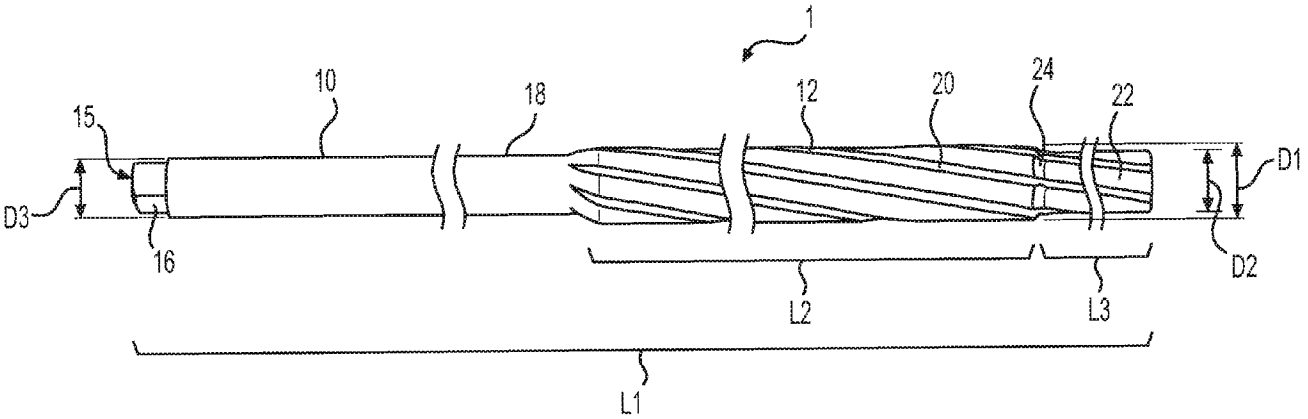
FIG. 1 is a side view of a valve guide cleaning reamer of the invention.
Figure 2:
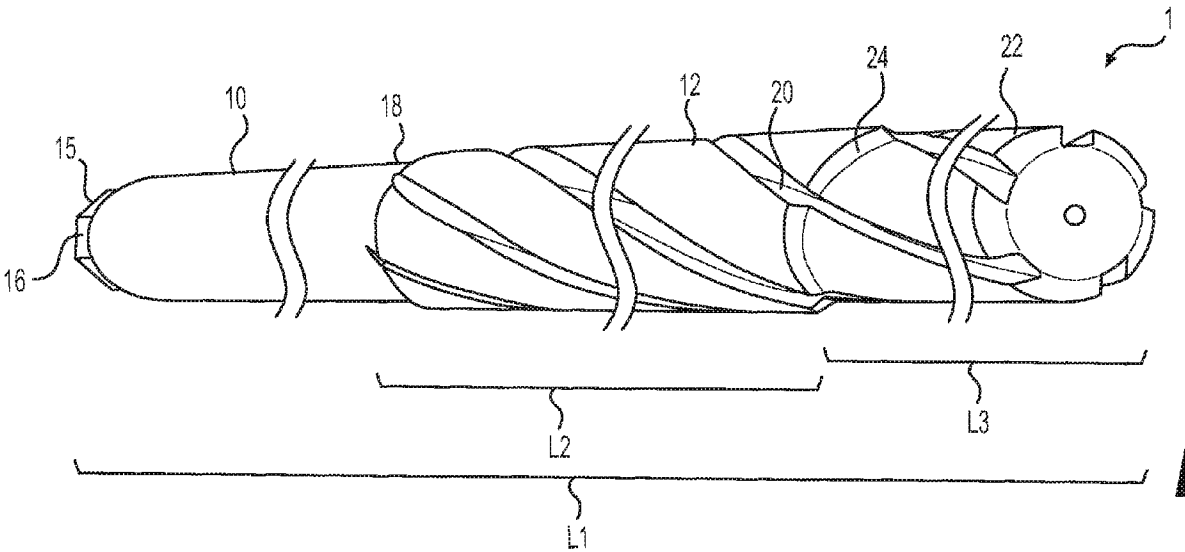
FIG. 2 is a top perspective view of the valve guide cleaning reamer of the invention.
Figure 3:
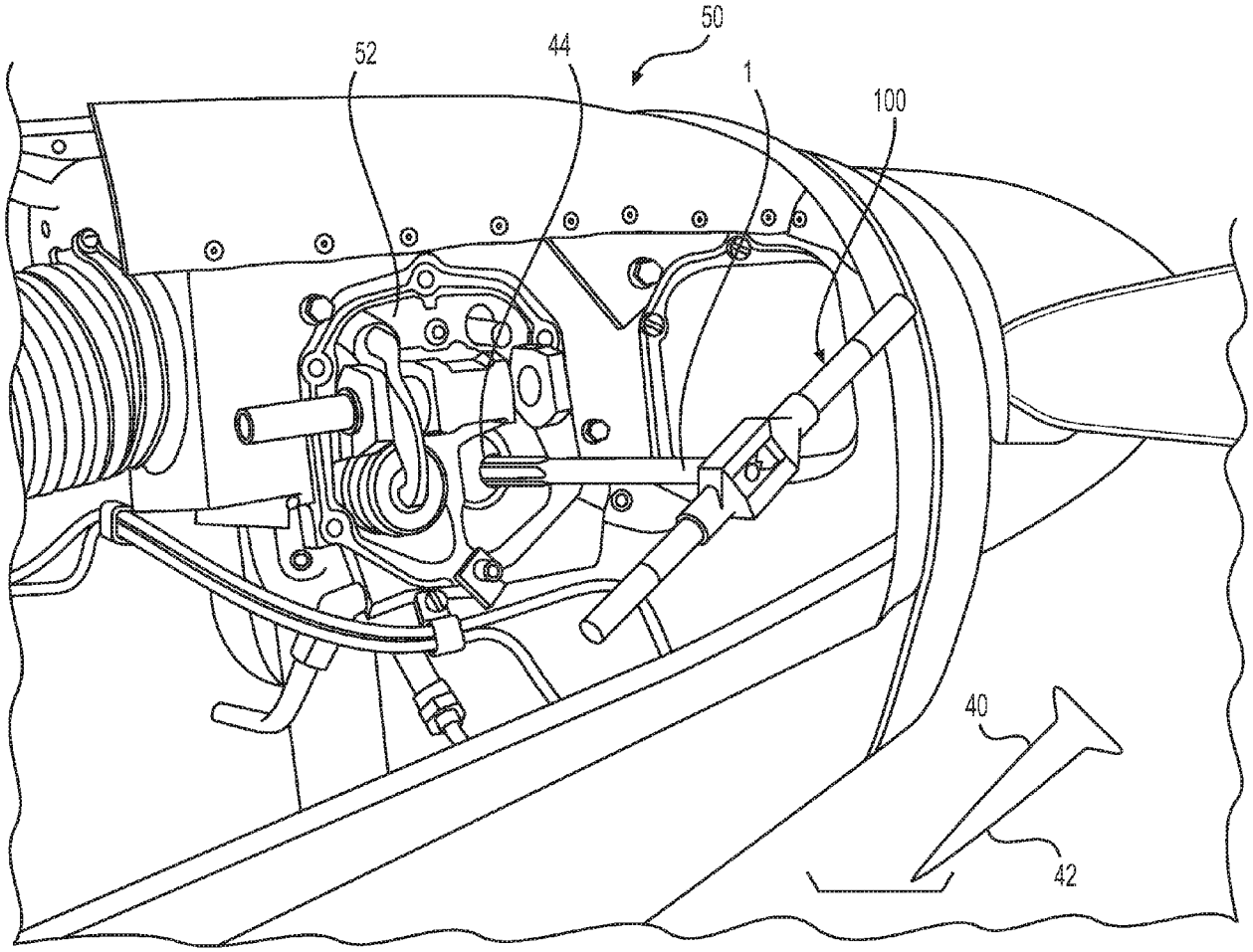
FIG. 3 is a top perspective view of the valve guide cleaning reamer in use with mechanical fingers cleaning a valve guide.

Referring to FIGS. 1-2, in one embodiment, a cleaning reamer 1 comprises a straight shank 10 and a body 12 with a pilot portion 22. The straight shank 10 of the cleaning reamer 1 is cylindrical and has at one end 15 an attachment portion 16 to be able to connect with a tool 100 that will rotate the reamer 1 in practice (FIG. 3). At the opposed end 18 of the straight shank 10 is the body 12 of the cleaning reamer. The body 12 as illustrated is right hand fluted with five flutes 20. It is foreseen that the fluted body 12 may have more or less flutes than illustrated.

At the end of the cleaning reamer 1 is a piloted or stepped portion 22. In the illustrated embodiment, the piloted portion 22 carries forth the flutes 20 of the body 12. It is foreseen that the piloted section 22 may be a straight material and non-fluted. The piloted portion 22 is separated from the body 12 by an undercut 24. The undercut 24 is disposed at angle A, i.e. 45 degrees. The undercut 24 allows for the capture of deposit material (not shown) with removal of the cleaning reamer 1 from a valve guide 44.

The cleaning reamer 1 has an overall length L1, which as an example may be within a range of 6.725 to 8.125 inches. The overall length L1 comprises a body length L2 and a pilot length L3. As an example, the body length L2 may be within a range of 2.925 to 3.075 inches and the pilot length L3 may be within a range of 0.7 to 0.8 inches.

The body 12 has the largest diameter D1, which may for an example be within a range of 0.404 to 0.5005 inches. The pilot portion 22 has a smaller diameter D2, which may be within a range of 0.4012 to 0.4965 inches. It may be particularly desirable for the pilot portion diameter D2 to be equivalent (i.e., plus or minus 0.0005 inches) or substantially equivalent (plus or minus 0.002 inches) to a diameter D4 of a valve stem 42 (FIG. 3). The straight shank 10 has a diameter D3 that is smaller than the piloted section diameter D2, for example 0.3 to 0.3865 inches. The attachment portion 16 is illustrated at 75% of straight shank diameter D3. It is foreseen that the attachment portion may be of a different dimension that that illustrated, such as either larger or smaller than diameter D3.

The cleaning reamer 1 may be made of any appropriate material capable of maintaining its shape while reaming a valve guide. In a preferred embodiment, the material may be high speed tool steel, such as M2 or M7, carbide, or HNV-3 and may be chrome plated or gas nitrided. The purpose of the plating is to conduct heat better.

The cleaning reamer 1 is cylindrically shaped, but may be a variety of shapes and sizes depending on the application. For example, the cleaning reamer 1 may come in various rectangular shapes.

It will be appreciated that FIGS. 1-2 teach by way of example and not limitation. The number of system components may be increased or decreased with respect to what is shown. In one such example, multiple pilot portions may be employed.

Figure 4:
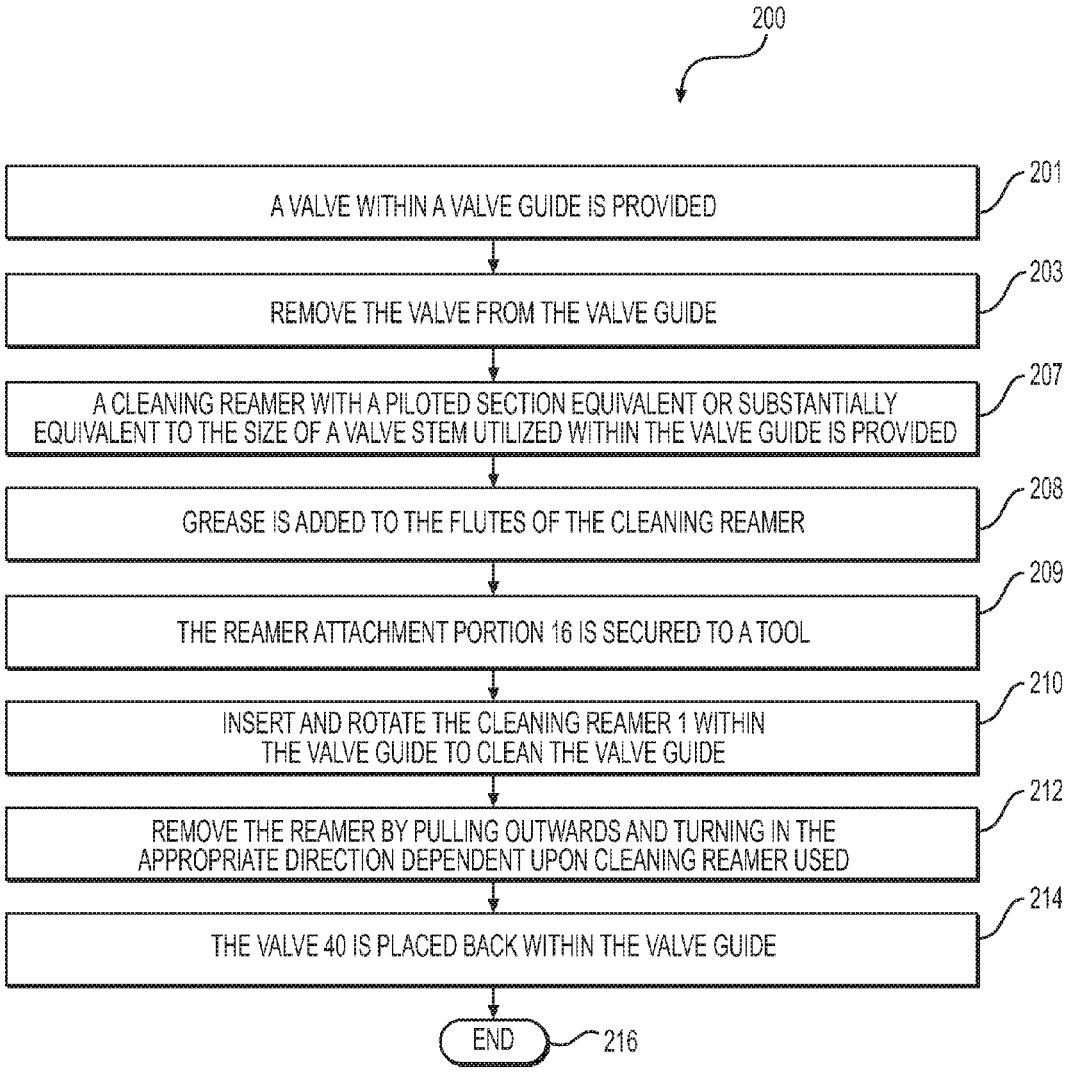
FIG. 4 is a method of cleaning a valve guide utilizing the valve guide cleaning reamer of the present invention.

Referring to FIGS. 3-4, a method 200 of cleaning a valve guide is shown. FIG. 3 shows an aircraft engine 50 with the rocker box cover and gasket removed from the cylinder head 52. FIG. 3 is merely illustrative and is not meant to limit the invention. Once determined that a valve 40 is sticking or stuck within the valve guide 44 (i.e. through clearance checks, visual, etc), and not due to erosion or any other condition, in which full replacement of the valve 40 and guide 44 is the only solution, the cleaning method may be implemented. The cleaning method may also be implemented as a preventative measure. For cleaning exhaust valves of aircraft, the Lycoming Service Bulletin 338C and 1425A are incorporated by reference herein in their entirety.

In step 201, valve 40 is provided within valve guide 44. This step further includes removing all structure blocking access to the valve 40 and the valve guide 44, including spark plugs, rocker box cover, gaskets, valve rocker shaft, rotator cap, exhaust rocker arm, retaining nut, washers, etc. In step 203, the valve 40 is removed from its guide 44, and positioned away from the guide 44 to avoid interference (FIG. 3).

In step 207, the cleaning reamer 1 is provided. The cleaning reamer 1 has a piloted section diameter equivalent to or substantially equivalent to the size of a valve stem diameter. In step 208, a lubricant, fluid, or grease is added to the flutes 20 of the cleaning reamer 1, so that deposits may be removed once the reamer 1 is withdrawn from the valve guide (not shown). In step 209, the reamer attachment portion 16 is secured to a tool, such as a reamer wrench, mechanical fingers, or the like.

In step 210, if using a right handed flute reamer, the cleaning reamer 1 is inserted within the valve guide 44 and turned clockwise; and if using a left handed flute cleaning reamer, the reamer is instead turned counter clockwise. This step 210 should be repeated until it gets easy to turn and most of the cleaning reamer 1 has disappeared into the guide 44. Ideally, the piloted section 22 should go past the length of the valve guide 44. The pilot portion 22 aligns the body 12 and effectively prevents creating a newly-formed hole that is misaligned from the valve guide 44. Thus, the reamer 1 in step 210 is configured significantly differently from a reamer which originally formed the valve guide 44 (and which does not have the pilot 22 as configured in the reamer 1). It may be desirable for the reamer 1 and the reamer which originally formed the valve guide 44 (which, as discussed above, has a pilot with a substantially smaller diameter) to be provided together as a kit.

In step 212, the reamer is removed by pulling outwards and turning in the appropriate direction dependent upon cleaning reamer used (i.e. right handed or left handed). In step 214, the valve 40 is placed back within the valve guide 44. If still sticking, then the cleaning process 200 is repeated; otherwise, the cleaning method ends at step 216.

Many different arrangements of the various components depicted, as well as components not shown, are possible without departing from the spirit and scope of the present invention. Embodiments of the present invention have been described with the intent to be illustrative rather than restrictive. Alternative embodiments will become apparent to those skilled in the art that do not depart from its scope. A skilled artisan may develop alternative means of implementing the aforementioned improvements without departing from the scope of the present invention. Further, it will be understood that certain features and subcombinations may be of utility and may be employed within the scope of the disclosure. Further, various steps set forth herein may be carried out in orders that differ from those set forth herein without departing from the scope of the present methods. This description shall not be restricted to the above embodiments.

It is to be understood that while certain forms of the present invention have been illustrated and described herein, it is not to be limited to the specific forms or arrangement of parts described and shown.

The invention claimed is:

1. A method for cleaning a valve guide, comprising the steps of:

a. providing a valve assembly including a valve housing with at least one valve guide bore having an inner diameter between 0.404 inches and 0.5005 inches, wherein the at least one valve guide bore holds a corresponding valve within the inner diameter, the valve having a valve stem and a valve head, the valve stem having a stem diameter between 0.4012 inches and 0.4965 inches, and removing the valve from the inner diameter of the at least one valve guide bore;

b. providing a reamer having a straight shank, a body, and a pilot section, the body having a first diameter between 0.404 inches and 0.5005 inches and the pilot section having a second diameter substantially equivalent to the stem diameter; and c. inserting and rotating the reamer within the valve bore to clean the bore.

2. The method of claim 1, wherein the body of the reamer is fluted.

3. The method of claim 1, wherein the pilot section second diameter is between 0.4012 and 0.402 inches.

4. The method of claim 1, wherein the pilot section second diameter is between 0.432 and 0.433 inches.

5. The method of claim 1, wherein the pilot section second diameter is between 0.4935 and 0.4945 inches.

6. The method of claim 1, wherein the pilot section second diameter is between 0.4957 and 0.4965 inches.

7. A method for forming and cleaning a valve guide, comprising the steps of:

a. providing a valve assembly including a valve housing;

b. providing a first reamer having an outer diameter;

c. reaming a valve bore within the valve housing, the valve bore being sized and shaped to support a corresponding valve within an inner diameter of the valve bore, the valve having a valve stem and a valve head, the valve stem having a stem diameter;

d. removing the valve from the valve bore;

e. providing a second reamer having a straight shank, a body, and a pilot section, the body having a first diameter substantially equivalent to the outer diameter of the first reamer and the pilot section having a second diameter substantially equivalent to the stem diameter; and f. inserting and rotating the second reamer within the valve bore to clean the bore.

8. The method of claim 7, wherein the first reamer outer diameter is between 0.404 inches and 0.5005 inches, and wherein the stem diameter is between 0.4012 inches and 0.4965 inches.

9. A method for cleaning a valve guide of an aircraft, comprising the steps of:

a. removing a valve from within a valve guide;

b. providing a cleaning reamer with a piloted section substantially equivalent to a size of a valve stem utilized within the valve guide;

c. inserting and rotating the cleaning reamer within the valve guide to clean the valve guide; and d. removing the cleaning reamer by pulling out the cleaning reamer from the valve guide.

10. The method according to claim 9, wherein the piloted section is equivalent to the size of the valve stem utilized within the valve guide.

11. The method according to claim 9, wherein the cleaning reamer has an attachment portion secured to a tool.

12. The method according to claim 9, wherein the cleaning reamer includes flutes.

13. The method according to claim 12, further comprising the step of adding grease to the flutes of the cleaning reamer.

* * * * *